US007784438B2

(12) United States Patent
Lee

(10) Patent No.: US 7,784,438 B2
(45) Date of Patent: Aug. 31, 2010

(54) MOUNTING MODULE OF OIL CONTROL VALVE FOR TAPPET CONTROL IN CYLINDER DEACTIVATION ENGINE

(75) Inventor: Seung Woo Lee, Seoul (KR)

(73) Assignee: Hyundai Motor Company, Seoul (KR)

( * ) Notice: Subject to any disclaimer, the term of this patent is extended or adjusted under 35 U.S.C. 154(b) by 455 days.

(21) Appl. No.: 11/869,531

(22) Filed: Oct. 9, 2007

(65) Prior Publication Data

US 2008/0110426 A1 May 15, 2008

(30) Foreign Application Priority Data

Nov. 14, 2006 (KR) ..... 10-2006-0112092

(51) Int. Cl.
*F01L 9/02* (2006.01)

(52) U.S. Cl. ..... 123/90.12; 123/90.13; 123/90.48; 123/193.5

(58) Field of Classification Search ..... 123/90.12, 123/90.13, 90.48, 90.52, 90.55, 193.5, 193.3
See application file for complete search history.

(56) References Cited

U.S. PATENT DOCUMENTS 6,584,951 B1 7/2003 Patel et al.
6,810,842 B2 11/2004 Itou
6,948,463 B2 * 9/2005 Mischker et al. ..... 123/90.12

FOREIGN PATENT DOCUMENTS

JP 11-264304 9/1999
JP 2000-199409 7/2000

* cited by examiner

*Primary Examiner*—Ching Chang
(74) *Attorney, Agent, or Firm*—Morgan, Lewis & Bockius LLP

(57) ABSTRACT

The present invention relates to a mounting module in which an oil control valve for tappet control is mounted in a cylinder deactivation engine. The mounting module of the invention is separately fabricated and coupled to the cylinder head and has various oil passages connecting the oil paths between the oil control valve and the cylinder head with each other and thereby the die structure for molding the cylinder head is simplified. Because of its separately fabricating process it is possible to design the part freely and in a small size and to reduce the cost of die, material, manufacturing and its weight as well. Furthermore, the number of related parts such as steel ball, taker plug, etc. and unnecessary portions in the shape are considerably reduced, thus providing an optimized structure and reducing the manufacturing cost as well as its weight.

5 Claims, 4 Drawing Sheets

MOUNTING MODULE OF OIL CONTROL VALVE FOR TAPPET CONTROL IN CYLINDER DEACTIVATION ENGINE

CROSS-REFERENCE TO RELATED APPLICATION

This application claims the benefit of Korean Patent Application No. 10-2006-0112092, filed on Nov. 14, 2006, the entire disclosure of which is hereby incorporated by reference.

BACKGROUND OF THE INVENTION

1. Field of the Invention

The present invention relates to a mounting module of an oil control valve and, more particularly, to a mounting module on which an oil control valve for tappet control is mounted in a cylinder deactivation engine.

2. Description of Related Art

Recently, a cylinder deactivation (hereinafter, referred to as "CDA"), in which the combustion operation of specific cylinders is not made under the conditions such as a coasting drive, has been applied for the purpose of improving fuel efficiency in an automotive engine.

The CDA is directed to a method for deactivating a portion of the cylinders when stopping a vehicle or driving a vehicle at cruise speed, in which the fuel supply and the operation of intake/exhaust valves for the corresponding cylinders to be deactivated are suspended.

For example, when a driver wants to stop a vehicle of an 8-cylinder engine in a driving state, there is no reason for generating power by operating all cylinders. Accordingly, each two cylinders in four banks (two-divided cylinder block in a V-type engine) is deactivated and the engine is operated with the remaining two cylinders in the four banks, thus improving the fuel efficiency, which is directed to the CDA.

Moreover, in case of a 6-cylinder engine, three cylinders in one bank are deactivated and other remaining three cylinders in the other bank are operated.

The CDA can be also applied to a vehicle driving at cruise speed. In this case, it is characterized to generate a combustion pressure higher than that produced in the 8-cylinder combustion by increasing the fuel injection amount and the air intake amount, since it is necessary to generate a sufficient power required in the cruise drive only with four cylinders.

As such, in the CDA control mode, it is possible to reduce the fuel consumption amount since the fuel is not supplied to four cylinders in both sides, and further it is possible to attain considerably a high fuel efficiency since the power loss caused by friction does not occur in the deactivated cylinders.

The CDA includes a process of simply intercepting the fuel and a valve deactivation process. The former has a drawback in that the opening and closing operation of the valves are continuously made even if the fuel is intercepted, thus causing pumping losses through the valves.

The valve deactivation process is to stop the operation of the valves by specially modifying tappets for driving the valves or by using a device for controlling a rocker arm and, particularly, a mechanism mainly used for controlling the valves' opening and closing is directed to a method of using switching tappets.

The switching tappet is controlled by an oil control valve OCV, in which a pressure of a cam is controlled not to act on a valve by a pressure of oil supplied through the oil control valve so that the corresponding valve is not opened and closed regardless of the operation of the corresponding cam.

Meanwhile, the oil control valve for controlling the switching tappet in the CDA engine is mounted on the rear of a cylinder head. As depicted in FIG. 1, a mounting portion 11 in which the oil control valve, not depicted, is integrally molded in the rear of the cylinder head 10, and a plurality of oil passages connected to an oil path of the oil control valve is established in the mounting portion 11.

The mounting portion 11 is molded integrally with the cylinder head during the die casting process. Here, to establish the oil passages connected to the oil path of the oil control valve in the mounting portion 11, the cylinder head 10 and the mounting portion 11 are integrally molded and, then, holes are penetrated from the outside at the respective positions of the oil passages in the mounting portion 11 using a separate device.

The oil passages in the mounting portion 11 integrally molded on the rear surface of the cylinder head 10 include an oil supply passage (P-port) 12, connected to an oil inlet portion of the oil control valve, for forwarding oil supplied from a main oil gallery to the oil inlet portion of the oil control valve, an oil drain passage (T-port) 13, connected to an oil drain portion of the oil control valve, for draining an overpressure oil discharged from the oil control valve to a predetermined path in the cylinder head; and an oil exhaust passage (A-port) 14, connected to an oil outlet portion of the oil control valve, for supplying oil, i.e., an operation oil for controlling a tappet, discharged through the oil outlet portion of the oil control valve, to the tappet.

Referring to FIG. 1, in the mounting portion 11 on which the oil control valve is mounted, reference numeral 15 denotes a valve position surface on which the oil control valve is attached disposing a gasket therebetween, and two valve position surfaces 15 for mounting two oil control valves thereon are depicted.

Reference numeral 16 denotes a hole into which the oil inlet portion of the oil control valve is inserted to be connected to the oil supply passage 12 in the mounting portion 11, and reference numeral 17 denotes a bolt connection hole through which the oil control valve is fixed to the mounting portion 11.

In an example depicted in the figure, the oil control valve receives oil from a main oil gallery through the oil supply passage 12 in the mounting portion 11, and an overpressure oil in the oil control valve is drained to a predetermined path of the cylinder head 10 through the oil drain passage 13.

Moreover, the oil supplied from the oil control valve to the tappet is transmitted to the cylinder head 10 through the oil exhaust passage 14 and finally supplied to the tappet.

In such a case where two oil control valves are mounted therein, it is necessary to process holes (marked with solid line arrows in FIG. 1) eight times in total (four times only for the oil supply passage, and more than eight holes are required according to the number of the oil control valve) to establish the oil supply passage 12, the oil drain passage 13 and the oil exhaust passage 14. Such a method in which the holes are penetrated from the outside to establish the respective oil passages has the following drawbacks.

First, the die structure for the cylinder head 10 is complicated since the mounting portion 11 is molded integrally with the cylinder head 10.

Moreover, in the process of penetrating holes for establishing the respective oil passages in the mounting portion 11 after molding the mounting portion 11 integrally as described above, the holes are penetrated by inserting a tool from the outside of the mounting portion 11 thereto, the holes remain penetrated through the mounting portion 11 externally to which the tool was inserted.

Accordingly, to close up the holes exposed externally of the respective oil passages in the mounting portion 11, steel balls (not shown) are inserted into the respective holes exposed externally or taper plugs (not shown) are mounted therein as depicted in FIG. 1.

In general, the steel balls are inserted into the holes exposed externally of the oil supply passage 12 and the oil exhaust passage 14, and the taper plug is mounted on the oil drain passage 13, since it is difficult to insert the steel ball as the hole pressing direction is tilted and the hole exposed externally is close to the steel ball insertion portions of the oil supply passage 12 and the oil exhaust passage 14 as depicted in FIG. 1.

Like this, since the hole pressing direction of the oil drain passage 13 is tilted, it is necessary to use a separate hole pressing device, differently from the process of pressing the oil supply passage 12 and the oil exhaust passage 14, thus increasing the equipment cost therefor.

Moreover, since it is necessary to establish the steel balls and the taper plugs as much as the number of the oil passages, the number of parts and processes are increased and particularly an additional tool for establishing the taper plug is required separately from the equipment for establishing the steel balls.

Furthermore, it is necessary to provide a slope in the cylinder head die due to the position of the oil drain passage and thereby unnecessary mass portions are generated due to the slope of the die, thus increasing the weight thereof.

The information disclosed in this Background of the Invention section is only for enhancement of understanding of the background of the invention and should not be taken as an acknowledgement or any form of suggestion that this information forms the prior art that is already known to a person skilled in the art.

SUMMARY OF THE INVENTION

The present invention has been contrived taking the above-described circumstances into consideration, and is directed to provide a mounting module of an oil control valve for tappet control in a cylinder deactivation engine that solves the conventional problems such as complicated processes, deteriorations of workability and assembly performance, application of numerous parts and difficulties in applying steel balls in a bundle after the hole process and, further, reduces the processing and assembling numbers of the cylinder head.

Moreover, the present invention is directed to provide a mounting module of an oil control valve in which the number of related parts such as steel ball, taker plug, etc. are considerably reduced and the unnecessary portions thereof are reduced, thus providing an optimized structure and reduced weight.

For these improvements, there is provided a mounting module of an oil control valve for tappet control in a cylinder deactivation engine, wherein the mounting module configured to be separated from the cylinder head but is mounted on a rear surface of a cylinder head and is directed to a portion, where the oil control valve for tappet control in a cylinder deactivation engine is mounted, and connects oil paths between the oil control valve and the cylinder head with each other, the mounting module comprising: a valve position surface, on which the oil control valve is mounted, established on the top thereof, a hole, through which an oil inlet portion of the oil control valve is inserted downward, is established on the top thereof, and a plurality of oil passages, connecting an oil path of the oil control valve and a corresponding oil path of the cylinder head with each other, formed therein.

Preferably, the plural oil passages include an oil supply passage connected to the oil inlet portion of the oil control valve, an oil drain passage connected to an oil drain portion of the oil control valve and an oil exhaust passage connected to an oil outlet portion of the oil control valve, the oil supply passage being established extending along the longitudinal direction therein to include a main path connected to the oil outlet portion of the oil control valve and having a structure, in which an inlet portion thereof for receiving oil through the oil path of the cylinder head is positioned on one side of a rear surface thereof that comes into contact with the rear surface of the cylinder head, and the inlet portion is connected to one end of the main path through an oil passage connected backward thereto.

Moreover, the main path is formed in such a manner that a hole thereof is processed externally and a steel ball for closing up the externally-exposed hole of one end of the main path is inserted therein.

Furthermore, outlet portions of the oil drain passage and the oil exhaust passage are positioned on the rear surface thereof joined with the rear surface of the cylinder head so that oil discharged from the oil drain portion and the oil outlet portion of the oil control valve connected to inlet portions thereof is supplied to the oil path of the cylinder head.

In addition, an outlet portion of the oil supply passage is positioned on the other side of the rear surface thereof so that an extra oil remaining after supplying to the oil control valve through the oil inlet portion is exhausted to the oil path of the cylinder head, and the outlet portion of the oil supply passage is connected to the other end of the main path.

Additionally, a plurality of bolt holes are further included to fix the mounting module to the cylinder head firmly in such a manner that the rear surface of the mounting module is joined with the rear surface of the cylinder head and, then, bolts inserted through the bolt holes are connected to the cylinder head.

The above features and advantages of the present invention will be apparent from or are set forth in more detail in the accompanying drawings, which are incorporated in and form a part of this specification, and the following Detailed Description of the Invention, which together serve to explain by way of example the principles of the present invention.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
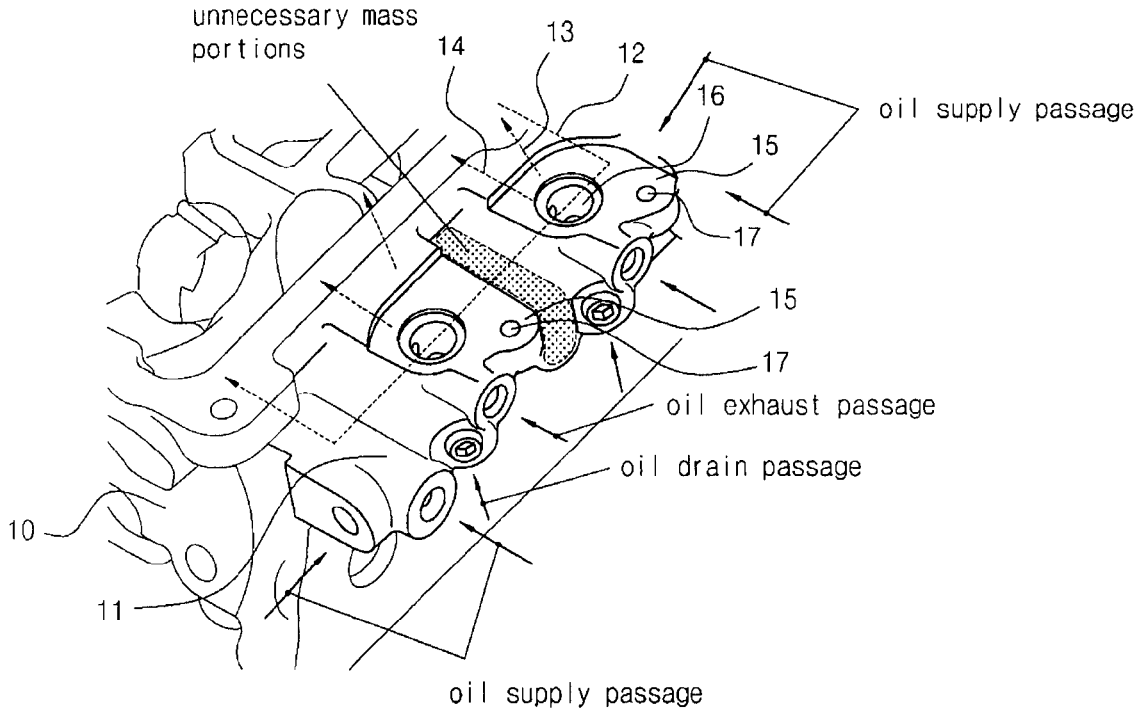
FIG. 1 is a perspective view depicting a conventional mounting portion integrated with a cylinder head, on which an oil control valve for controlling a tappet is mounted, and an oil passage structure thereof.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment. Certain features of the illustrated embodiments have been enlarged or distorted relative to others to facilitate visualization and clear understanding.

In the figures, reference numbers refer to the same or equivalent parts of the present invention throughout the several figures of the drawing.

DETAILED DESCRIPTION OF THE INVENTION

Hereinafter, reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Figure 2:
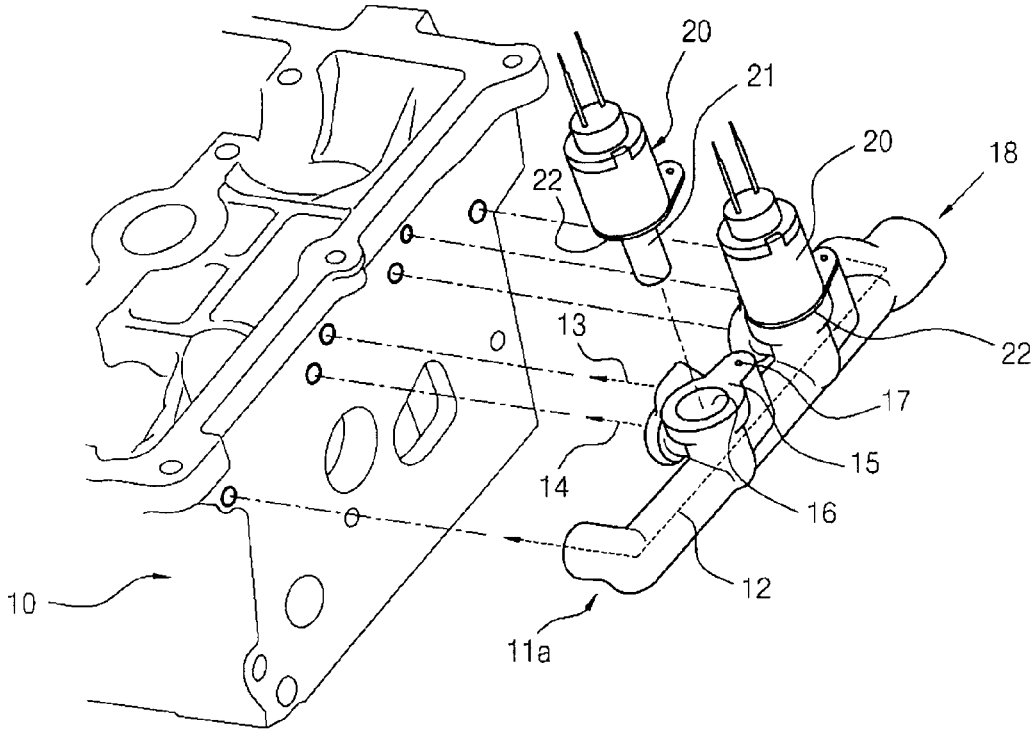
FIG. 2 is a perspective view depicting a mounting module, configured to be separated from a cylinder head 10, for mounting an oil control valve in accordance with the present invention.

FIG. 2 is a perspective view depicting a mounting module, configured to be separately mountable to a cylinder head 10, for mounting an oil control valve 20 in accordance with the present invention, in which the cylinder head 10, the mounting module 11*a* of the present invention and the oil control valve 20 are all separable from each other.

As depicted in the figure, the mounting module 11*a* in accordance with the present invention is directed to provide a portion, where oil control valves 20 are mounted thereto in a cylinder deactivation engine, manufactured as an individual part separated from the cylinder head 10 and provided in the form of a module in which oil passages are formed.

The oil control valve 20 for controlling the operation of a switching tappet in the cylinder deactivation engine is depicted In FIG. 2. Here, the switching tappet, not depicted in the figure, is configured to receive an operation oil from the oil control valve 20 to suspend the operation of intake/exhaust valves as described above in the related art. The switching tappet operates so that the pressure of a cam does not act on the corresponding valve by the pressure of oil, thus preventing the valve from being opened and closed regardless of the operation of the cam.

Since the structure of the oil control valve is the same as the conventional one, detailed description will be omitted.

The mounting module 11*a* in accordance with the present invention is mounted on the rear of the cylinder head 10. That is, the mounting module 11*a* is manufactured by a die molding process separately from the cylinder head 10 and then coupled to the rear of the cylinder head 10.

Accordingly, a separate die for casting the mounting module 11*a* is required. However, since the mounting module 11*a* can be fabricated in a small size with a simplified structure, there is no difficulty in manufacturing the corresponding die and, further, it has some advantages in that the layout efficiency of the mounting module 11*a* is improved because of the simplified die structure for molding the cylinder head 10.

Figure 3:
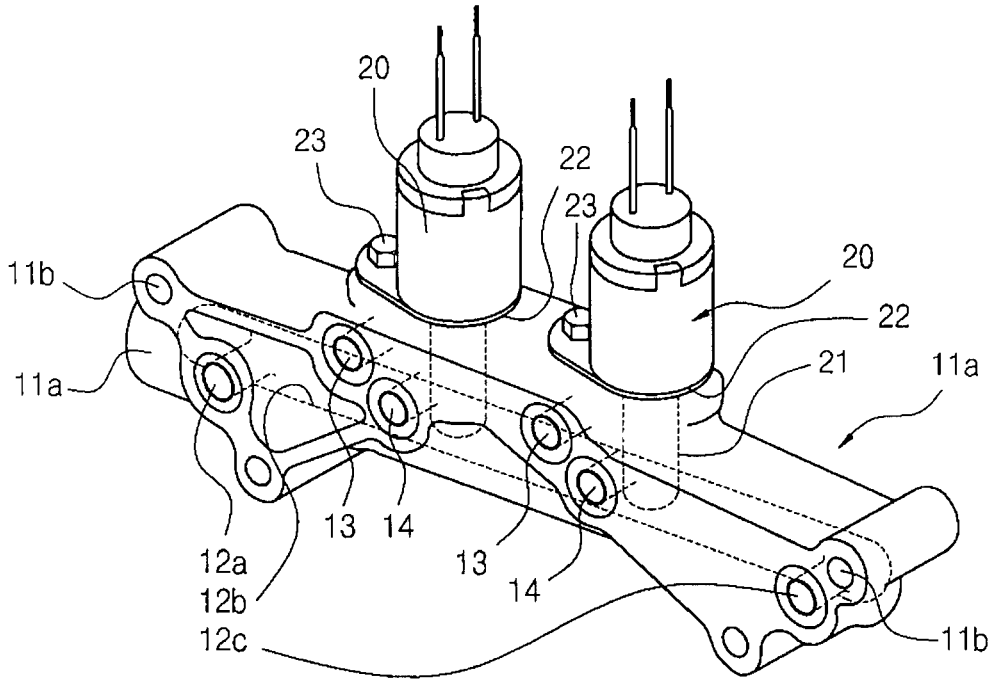
FIG. 3 is a rear perspective view of a mounting module in accordance with the present invention.
Figure 4:
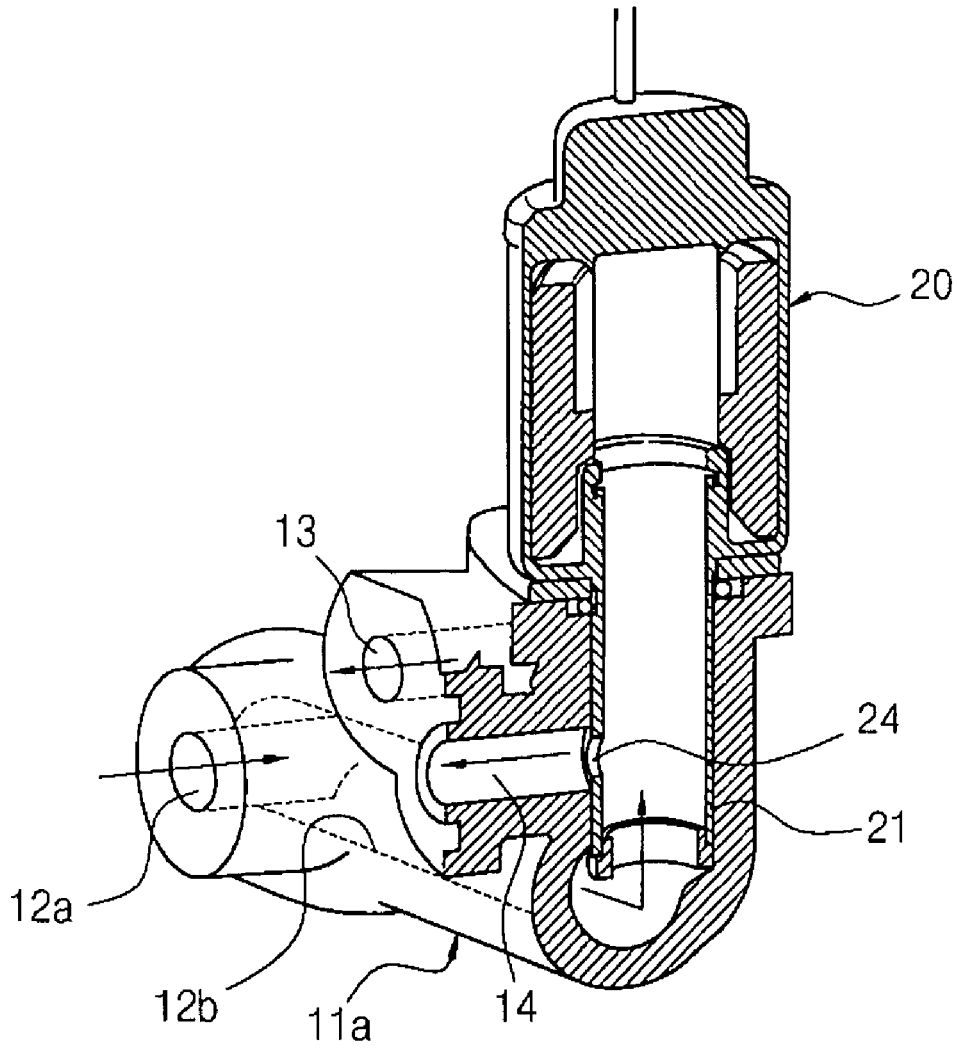
FIG. 4 is an exploded perspective view depicting a state where a mounting module and an oil control valve are connected to each other in accordance with the present invention.

FIG. 3 is a rear perspective view of the mounting module in accordance with the present invention, and FIG. 4 is an exploded perspective view depicting the state where the mounting module and the oil control valve are coupled to each other.

The mounting module 11*a* is directed to provide a portion on which the oil control valve 20 is mounted and, at the same time, connects the oil paths between the oil control valve 20 and the cylinder head 10 with each other for fluid communication.

For this purpose, a plurality of oil passages for coupling the oil path of the oil control valve 20 and that of the cylinder head 10 are established in the mounting module 11*a*. Each of the oil passages comprises an oil supply passage (P-port) 12, connected to an oil inlet portion 21 of the oil control valve 20, for forwarding the oil supplied from a main oil gallery to the oil inlet portion 21 of the oil control valve 20, an oil drain passage (T-port) 13, connected to an oil drain portion (not shown) of the oil control valve 20, for draining an overpressure oil discharged from the oil control valve 20 to a predetermined path in the cylinder head 10, and an oil exhaust passage (A-port) 14, connected to an oil outlet portion 24 of the oil control valve 20, for supplying oil, i.e., an operation oil for controlling a tappet, discharged through the oil outlet portion 24 of the oil control valve 20, to the tappet.

Referring back to FIG. 2, in the mounting module 11*a* of the present invention in which the oil control valve 20 is mounted, reference numeral 15 denotes a valve position surface on which the oil control valve 20 is coupled disposing a gasket 22 therebetween, and two valve position surfaces 15 (not shown) for mounting two oil control valves 20 thereon are depicted.

Reference numeral 16 denotes a hole into which the oil inlet portion 21 of the oil control valve 20 is inserted downward in the vertical direction to be connected to the oil supply passage 12 in the mounting module 11*a* for fluid communication, and reference numeral 17 denotes a bolt connection hole through which the oil control valve 20 is coupled to the mounting module 11*a*.

Referring to FIG. 3, two oil control valves 20 are connected to the mounting module 11*a* by bolts 23 in the state where the gaskets 22 are disposed therebetween. The oil supply passage 12 comprises an inlet portion 12*a*, main path 12*b* and outlet portion 12*c*.

Moreover, in FIG. 3, an inlet portion 12*a* of the oil supply passage 12 receiving oil of the main oil gallery from the cylinder head 10 is positioned on one side of the rear surface of the mounting module 11*a* that comes in contact with the rear surface of the cylinder head 10. The oil supply passage 12 is connected from the inlet portion 12*a* of the rear surface of the mounting module 11*a* to the inside of the mounting module 11*a* backward and, then, extends along the longitudinal direction of the mounting module 11*a*. The oil inlet portions 21 of the respective oil control valves 20 inserted downward in the vertical direction are coupled in the middle of the path (hereinafter, referred to as the main path 12*b*) extending along the longitudinal direction of the mounting module 11*a*.

Furthermore, an outlet portion 12*c* of the oil supply passage 12 is positioned on the opposite side of the inlet portion 12*a* of the oil supply passage 12 on the other side of the rear surface of the mounting module 11*a*. The outlet portion 12*c* of the rear surface of the mounting module 11*a* is connected from the rear surface of the mounting module 11*a* backward for fluid communication and, then, coupled to one end of the main path 12*b*.

Accordingly, the extra oil remaining after supplying to the oil control valve 20 is delivered to a predetermined path of the cylinder head 10 through the outlet portion 12*c* of the oil supply passage 12 and, then, supplied to an intake camshaft.

As described in FIGS. 3 and 4, an outlet portion of the oil drain passage 13 in the mounting module 11*a* is positioned on the rear surface of the mounting module 11*a* and established long backward from the outlet portion and thereby an inlet portion 12*a* thereof is connected to the oil drain portion of the oil control valve 20.

Moreover, an outlet portion of the oil exhaust passage 14 in the mounting module 11*a* is positioned on the rear surface of the mounting module 11*a* and established long backward from the outlet portion and thereby an inlet portion 12*a* thereof is connected to the oil outlet portion 24 of the oil control valve 20.

In FIG. 3, reference numeral 11*b* denotes a bolt hole through which a bolt, not depicted, penetrates to couple the mounting module 11*a* to the rear surface of the cylinder head 10.

The bolt hole 11*b* may be formed plurally penetrating through the mounting module 11*a*. In the process of mounting the mounting module 11*a* of the present invention to the rear surface of the cylinder head 10, the rear surface of the mounting module 11*a* is coupled with the rear surface of the cylinder head 10 by disposing the gasket (not shown) therebetween and, then, the bolts inserted through the bolt holes 11*b* are inserted and connected to connection holes formed on the rear surface of the cylinder head 10, thus connecting the mounting module 11*a* to the cylinder head 10 firmly.

Like this, the oil control valves 20 receive oil of the main oil gallery through the oil supply passage 12 in the mounting module 11*a*, and the overpressure oil in the oil control valve 20 is drained to a predetermined path of the cylinder head 10 through the oil drain passages 13.

The oil supplied from the oil control valve 20 to the tappet is forwarded to the cylinder head 10 through the oil exhaust passage 14 and finally supplied to the tappet through a predetermined path in the cylinder head 10.

Of course, in the mounting module 11*a* of the present invention, the oil supply passage 12 is connected to a predetermined path in the cylinder head 10, to which the oil of the main oil gallery is supplied, and the oil drain passage 13 and the oil exhaust passage 14 are also coupled to a predetermined path in the cylinder head 10 according to their ends. Here, since the path in the cylinder head 10 connected to the respective oil passages of the mounting module has no difference from that of the conventional art, its description will be omitted.

Since the main path 12*b* of the oil supply passage 12 is established along the longitudinal direction in the mounting module 11*a* of the present invention, it is necessary to form a hole using a separate hole processing device to establish the main path 12*b* after the molding process of the mounting module 11*a*.

Here, to close up the hole portion exposed externally, a steel ball is inserted into the externally-exposed hole portion 18 as depicted in FIG. 2. According to the mounting module 11*a* of the present invention, a single steel ball is used for closing up the externally-exposed hole portion 18 of the main path 12*b* of the oil supply passage 12, thus reducing the number of parts remarkably compared with the conventional art.

As described above, the mounting module for mounting the oil control valve in accordance with the present invention is fabricated as a separate part from the cylinder head and has a structure in which various oil passages connecting the oil paths between the oil control valve and the cylinder head with each other are established therein, thus having the following effects:

1) It is fabricated by a die molding process different from the cylinder head and thereby the die structure for molding the cylinder head is simplified.

2) Since it is an individual part separately fabricated from the cylinder head, it has numerous advantages in that it is possible to design the part freely and in a small size and to reduce the die cost, material cost, manufacturing cost and its weight as well.

3) Since the number of related parts such as steel ball, taker plug, etc. is considerably reduced and the unnecessary portions in the shape thereof are reduced, thus providing an optimized structure and reducing the manufacturing cost as well as its weight.

4) It is possible to solve the conventional problems such as complicated processes, deteriorations of workability and assembly performance, application of numerous parts and difficulties in applying steel balls in a bundle after the hole process and, further, it is possible to reduce the processing and assembling numbers of the cylinder head. Moreover, in the case where the oil passages are fabricated by a die molding process, it is also possible to reduce the number of processes and the equipment cost for processing holes.

As above, preferred embodiments of the present invention have been described and illustrated, however, the present invention is not limited thereto, rather, it should be understood that various modifications and variations of the present invention can be made thereto by those skilled in the art without departing from the spirit and the technical scope of the present invention as defined by the appended claims.

What is claimed is:

1. A mounting module of an oil control valve for tappet control in a cylinder deactivation engine, wherein the mounting module is configured to be separated from the cylinder head and mounted on a rear surface of a cylinder head and the oil control valve for tappet control in a cylinder deactivation engine is mounted thereto, and connects oil paths between the oil control valve and the cylinder head with each other for fluid communication, the mounting module comprising:

a valve position surface, on which the oil control valve is mounted, thereof;

a hole established on a side of the mounting module, through which an oil inlet portion of the oil control valve is inserted, and a plurality of oil passages, connecting an oil path of the oil control valve and a corresponding oil path of the cylinder head with each other, formed therein, wherein the plural oil passages include an oil supply passage connected to the oil inlet portion of the oil control valve, an oil drain passage connected to an oil drain portion of the oil control valve and an oil exhaust passage connected to an oil outlet portion of the oil control valve, the oil supply passage being established extending along the longitudinal direction therein to include a main path connected to the oil outlet portion of the oil control valve and having a structure, in which an inlet portion thereof for receiving oil from the oil path of the cylinder head is positioned on one side of a rear surface thereof that comes into contact with the rear surface of the cylinder head, and the inlet portion is connected to one end of the main path through an oil passage connected backward thereto.

2. The mounting module of an oil control valve for tappet control in a cylinder deactivation engine as recited in claim 1, wherein the main path is formed in such a manner that a hole thereof is processed externally and a steel ball for closing up the externally-exposed hole of one end of the main path is inserted therein.

3. The mounting module of an oil control valve for tappet control in a cylinder deactivation engine as recited in claim 1, wherein outlet portions of the oil drain passage and the oil exhaust passage are positioned on the rear surface thereof joined with the rear surface of the cylinder head so that oil discharged from the oil drain portion and the oil outlet portion of the oil control valve connected to inlet portions thereof is supplied to the oil path of the cylinder head.

4. The mounting module of an oil control valve for tappet control in a cylinder deactivation engine as recited in claim 1, wherein an outlet portion of the oil supply passage is positioned on the other side of the rear surface thereof so that an extra oil remaining after supplying to the oil control valve through the oil inlet portion is exhausted to the oil path of the cylinder head, and the outlet portion of the oil supply passage is connected to the other end of the main path.

5. The mounting module of an oil control valve for tappet control in a cylinder deactivation engine as recited in claim 1, wherein a plurality of bolt holes are further included to fix the mounting module to the cylinder head firmly in such a manner that the rear surface of the mounting module is joined with the rear surface of the cylinder head 11 and, then, bolts inserted through the bolt holes are connected to the cylinder head.

* * * * *